US011295909B2

(12) United States Patent
Hsieh et al.

(10) Patent No.: US 11,295,909 B2
(45) Date of Patent: Apr. 5, 2022

(54) KEYSWITCH DEVICE

(71) Applicant: Chicony Electronics Co., Ltd., New Taipei (TW)

(72) Inventors: Chao-Chin Hsieh, New Taipei (TW); Chun-Chieh Chan, New Taipei (TW); Ping-Chen Li, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 17/203,727

(22) Filed: Mar. 16, 2021

(65) Prior Publication Data

US 2022/0044887 A1 Feb. 10, 2022

(30) Foreign Application Priority Data

Aug. 5, 2020 (TW) ..... 109126576

(51) Int. Cl.
*H01H 13/70* (2006.01)

(52) U.S. Cl.
CPC ..... *H01H 13/70* (2013.01); *H01H 2233/07* (2013.01)

(58) Field of Classification Search
CPC .... H01H 13/70; H01H 2233/07; H01H 13/14; H01H 13/76
USPC ..... 200/5 A, 341
See application file for complete search history.

(56) References Cited

U.S. PATENT DOCUMENTS 5,914,468 A * 6/1999 Nishimura ..... H01H 13/705 200/5 A
2009/0260970 A1* 10/2009 Tsai ..... H01H 3/125 200/5 A

* cited by examiner

*Primary Examiner* — Edwin A. Leon
*Assistant Examiner* — Iman Malakooti
(74) *Attorney, Agent, or Firm* — CKC & Partners Co., LLC

(57) ABSTRACT

A keyswitch device includes a connecting member and a keycap. The connecting member has an engaging shaft. The keycap includes a pressing body and a shaft hole structure. The pressing body has a bottom surface. The shaft hole structure is connected to the bottom surface and has an engaging trough and an inlet passage communicated with each other. The engaging shaft is rotatably engaged in the engaging trough. The inlet passage has a first inner wall and a second inner wall opposite and parallel to each other. The first inner wall and the second inner wall are inclined relative to the bottom surface of the pressing body.

12 Claims, 11 Drawing Sheets

330

530

630

730

KEYSWITCH DEVICE

CROSS-REFERENCE TO RELATED APPLICATION

This application claims priority to Taiwan Application Serial Number 109126576, filed Aug. 5, 2020, which is herein incorporated by reference.

BACKGROUND

Technical Field

The present disclosure relates to a keyswitch device.

Description of Related Art

Currently, the keyboard is one of the indispensable input devices to enter text or numbers while using a personal computer (PC). Moreover, consumer electronic products used in daily life or large-scale processing equipment used in the industrial sector require keyswitches as input devices to be operated.

Keycaps of a keyboard generally use narrow-mouth structures (for example, water drop holes) to connect with connection structures below. However, in the keycap pull test, there is often a problem of insufficient tensile strength causing the keycaps to fall off.

Accordingly, how to provide a keyswitch device to solve the aforementioned problems becomes an important issue to be solved by those in the industry.

SUMMARY

An aspect of the disclosure is to provide a keyswitch device that can efficiently solve the aforementioned problems.

According to an embodiment of the disclosure, a keyswitch device includes a connecting member and a keycap. The connecting member has an engaging shaft. The keycap includes a pressing body and a shaft hole structure. The pressing body has a bottom surface. The shaft hole structure is connected to the bottom surface and has an engaging trough and an inlet passage communicated with each other. The engaging shaft is rotatably engaged in the engaging trough. The inlet passage has a first inner wall and a second inner wall opposite and parallel to each other. The first inner wall and the second inner wall are inclined relative to the bottom surface of the pressing body.

In an embodiment of the disclosure, the engaging shaft has a central axis. An imaginary line extending along a radial direction perpendicular to the central axis is equally spaced between the first inner wall and the second inner wall.

In an embodiment of the disclosure, the shaft hole structure includes at least one first side engaging block and at least one second side engaging block. The at least one first side engaging block forms one part of the engaging trough and has the first inner wall. The at least one second side engaging block forms another part of the engaging trough and has the second inner wall. The at least one first side engaging block and the at least one second side engaging block are connected to the bottom surface and spaced apart from each other.

In an embodiment of the disclosure, the at least one first side engaging block and the at least one second side engaging block respectively has a first engaging wall and a second engaging wall. The first engaging wall and the second engaging wall are respectively connected to the first inner wall and the second inner wall and configured to be engaged with the engaging shaft. The engaging trough is formed at least by the first engaging wall and the second engaging wall.

In an embodiment of the disclosure, at least one part of one the first engaging wall and the second engaging wall is a straight wall.

In an embodiment of the disclosure, the straight wall is perpendicular to the bottom surface of the pressing body.

In an embodiment of the disclosure, the straight wall is inclined relative to the bottom surface of the pressing body.

In an embodiment of the disclosure, the first engaging wall is an arcuate wall.

In an embodiment of the disclosure, the shaft hole structure includes a first bottom surface and a second bottom surface. A height of the first bottom surface relative to the bottom surface of the pressing body is greater than a height of the second bottom surface relative to the bottom surface of the pressing body.

In an embodiment of the disclosure, the first inner wall is closer to a center of the pressing body than the second inner wall. The first inner wall and the second inner wall are inclined away from the center of the pressing body.

In an embodiment of the disclosure, an included angle is formed between a normal line of the bottom surface and the first inner wall. The included angle is 10 to 45 degrees.

In an embodiment of the disclosure, the shaft hole structure further includes a chamfer. The chamfer is connected to an end of the first inner wall away from the engaging trough.

Accordingly, in the keyswitch device of the present disclosure, since the shaft hole structure at the bottom of the keycap has the inclined inlet passage (i.e., the first inner wall and the second inner wall are inclined relative to the bottom surface of the pressing body), the amount of interference in a horizontal direction between the shaft hole structure and the engaging shaft of the connecting member below can be increased during a pull test of the keycap, thereby effectively improving the tensile strength of the keycap. Furthermore, by making the first inner wall and the second inner wall parallel to each other, the structural strength of the shaft hole structure at the inlet passage can be effectively increased, thereby further improving the tensile strength of the keycap.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
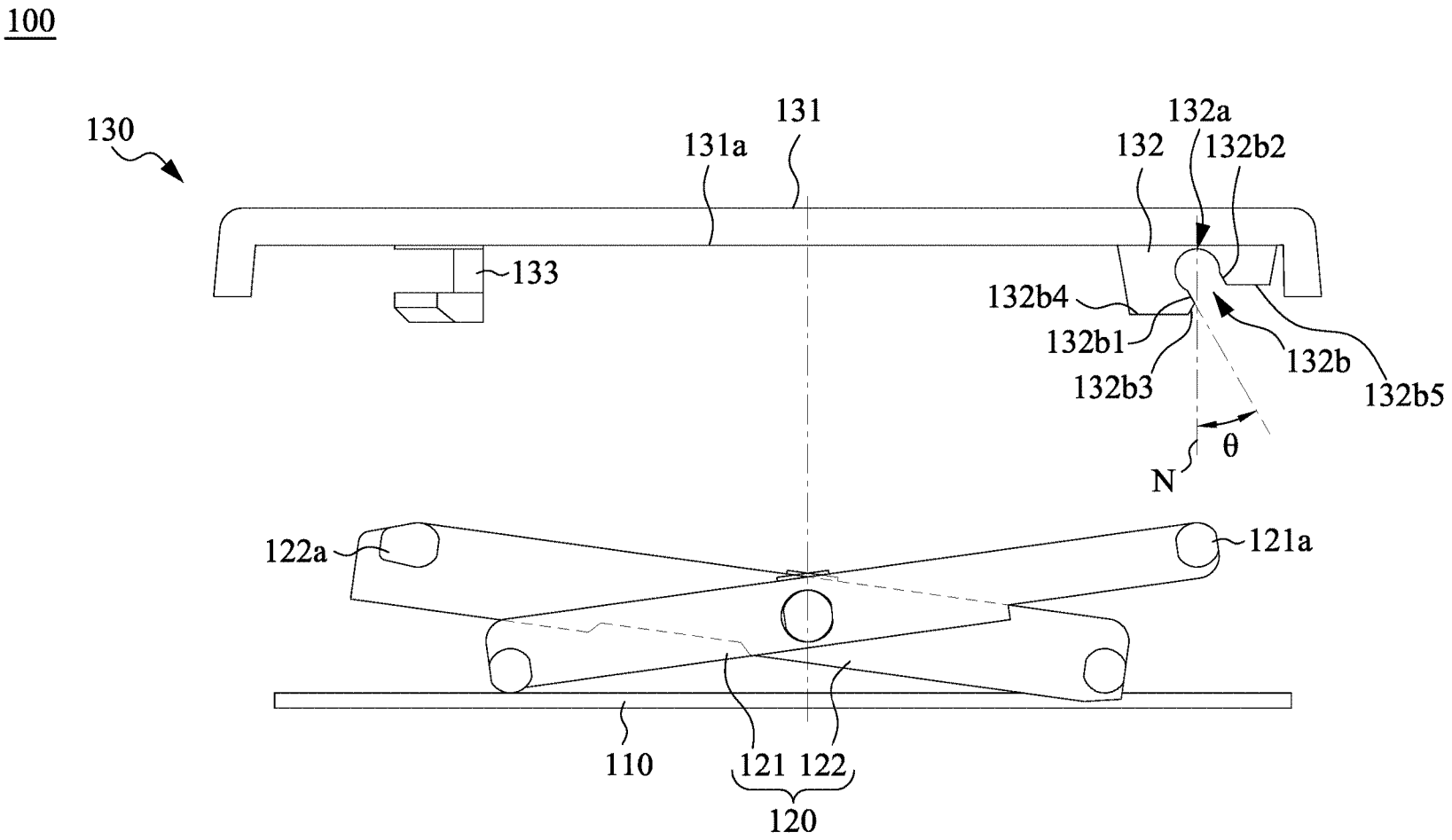
FIG. 1 is a schematic diagram showing an assembly stage of a keyswitch device according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Figure 2:
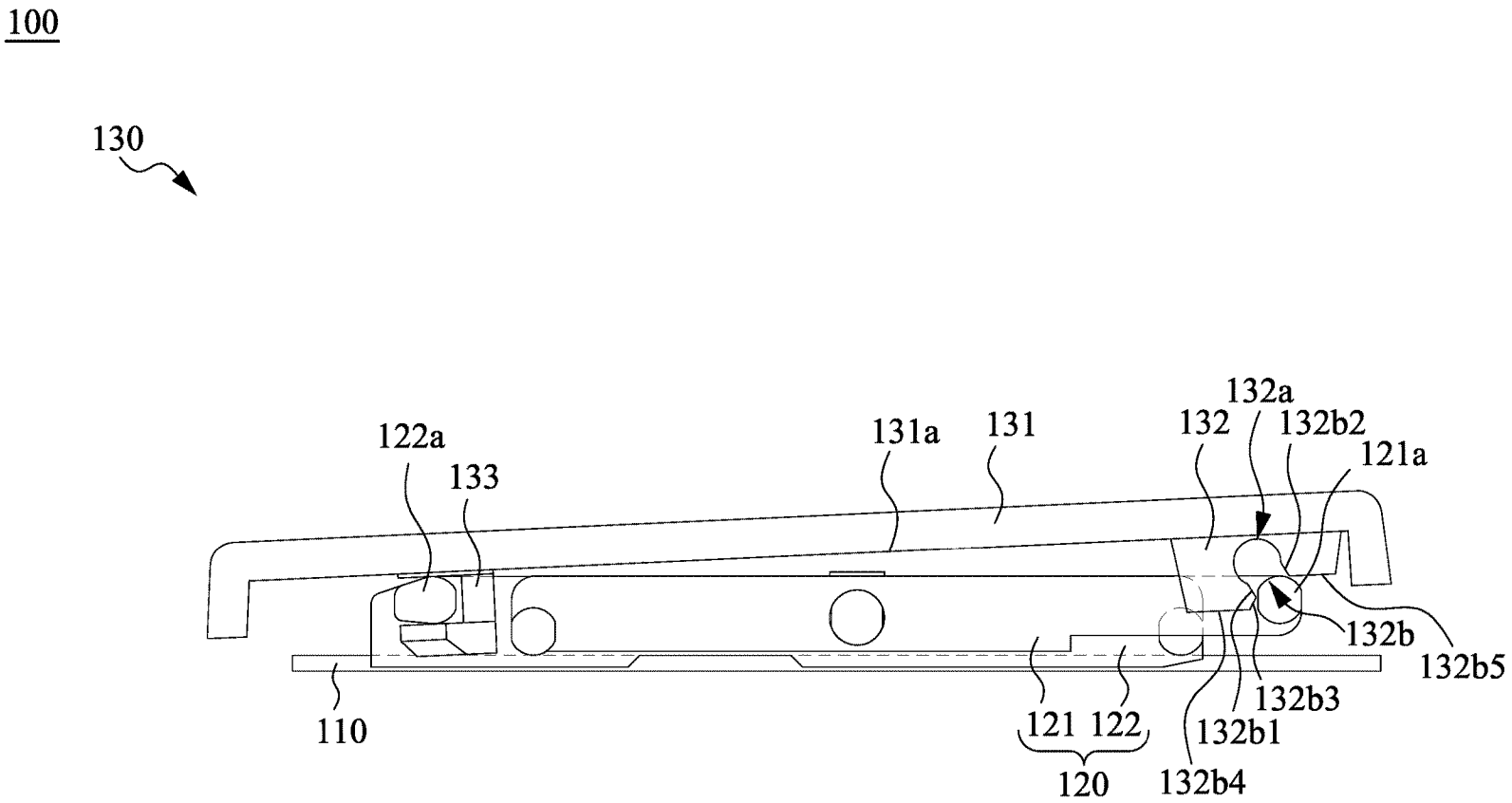
FIG. 2 is a schematic diagram showing the next assembly stage of the keyswitch device in FIG. 1.
Figure 3:
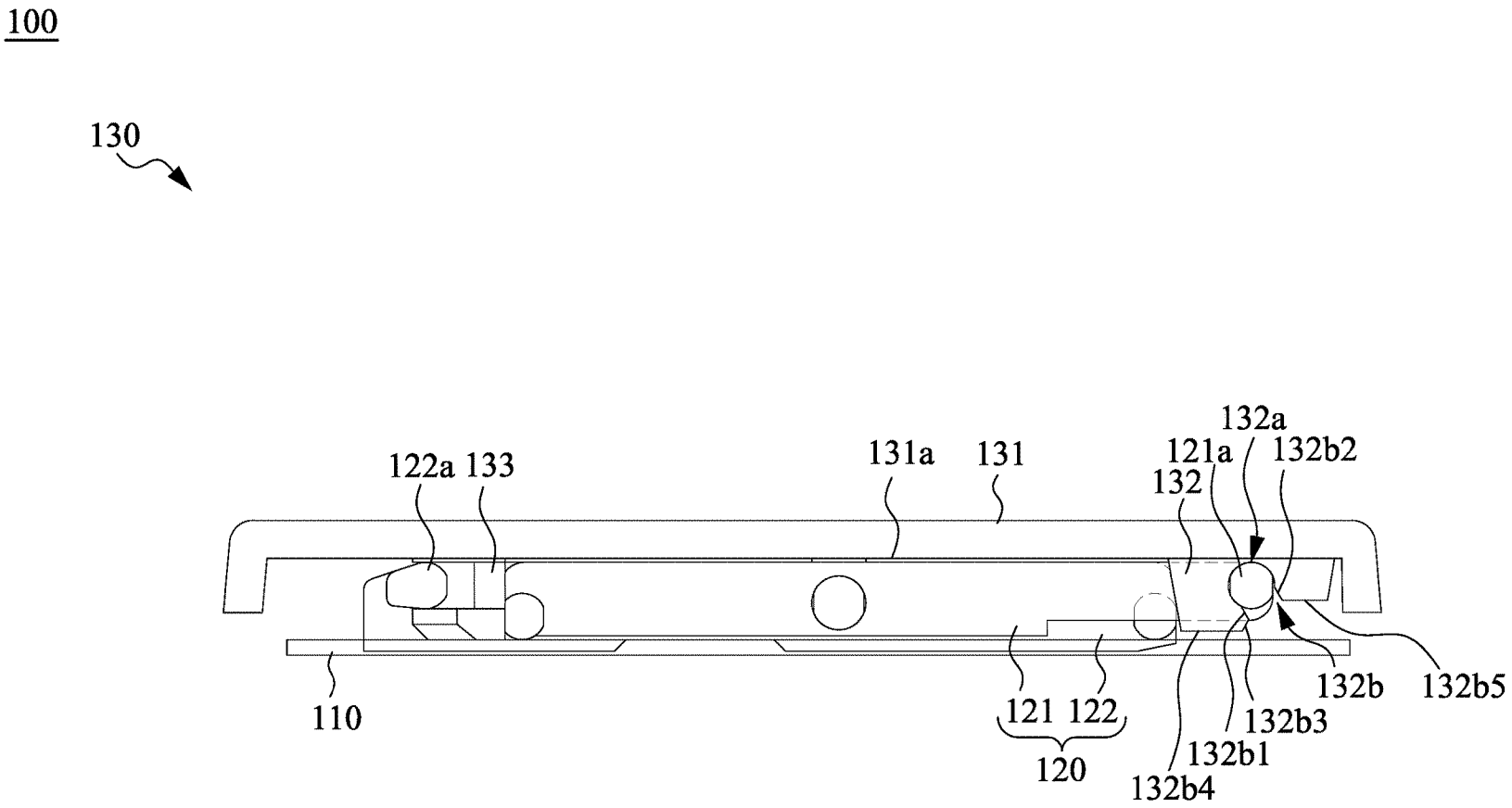
FIG. 3 is a schematic diagram showing the next assembly stage of the keyswitch device in FIG. 2.
Figure 4:
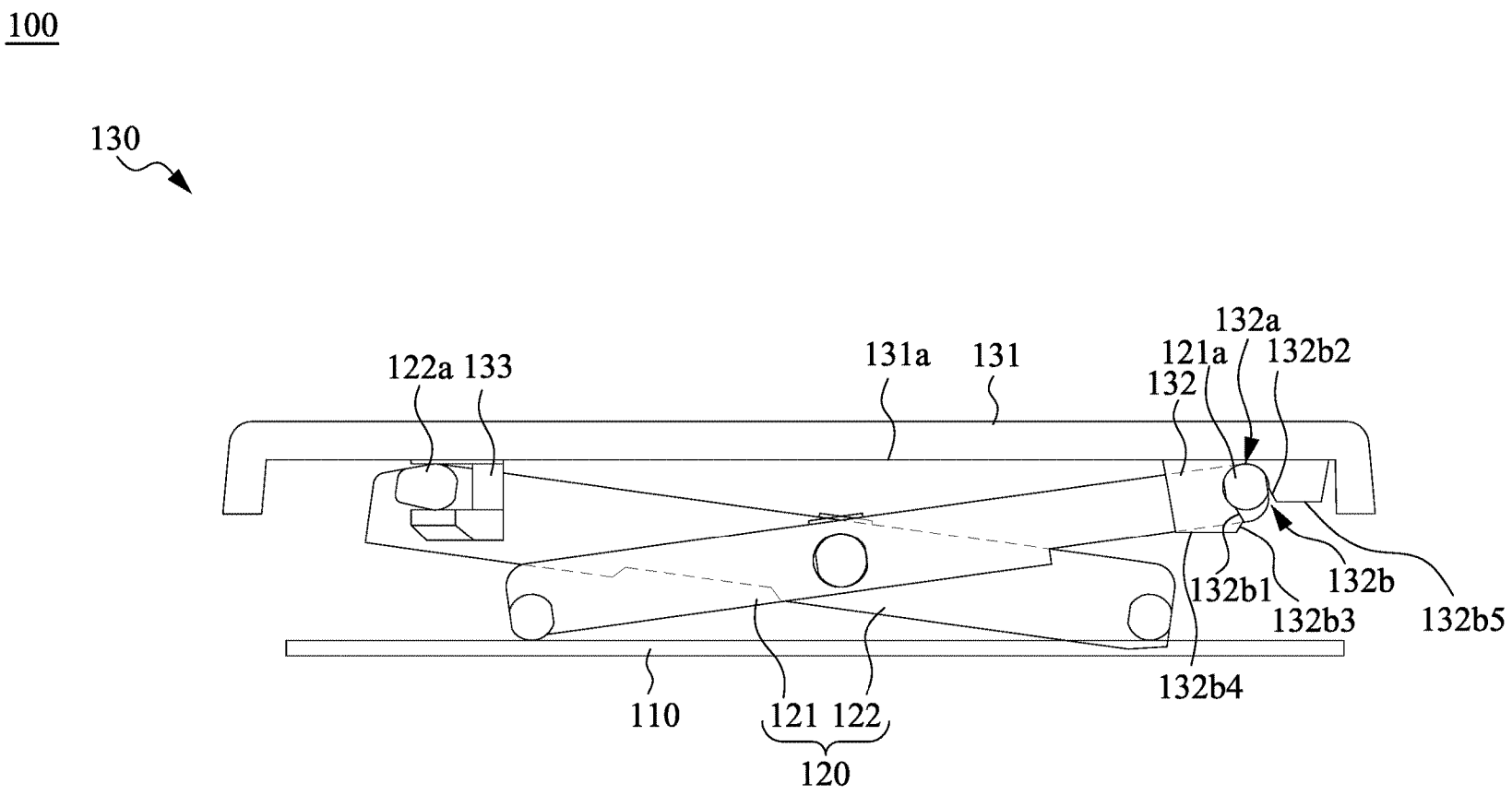
FIG. 4 is a schematic diagram showing the next assembly stage of the keyswitch device in FIG. 3.

Reference is made to FIGS. 1 to 4. FIG. 1 is a schematic diagram showing an assembly stage of a keyswitch device 100 according to an embodiment of the present disclosure. FIG. 2 is a schematic diagram showing the next assembly stage of the keyswitch device 100 in FIG. 1. FIG. 3 is a schematic diagram showing the next assembly stage of the keyswitch device 100 in FIG. 2. FIG. 4 is a schematic diagram showing the next assembly stage of the keyswitch device 100 in FIG. 3. As shown in FIG. 1, in the present embodiment, the keyswitch device 100 includes a bottom plate 110, a connecting assembly 120, and a keycap 130. The connecting assembly 120 is connected between the bottom plate 110 and the keycap 130, and is configured to move the keycap 130 upward and downward relative to the bottom plate 110. The connecting assembly 120 includes connecting members 121, 122. The connecting member 121 has an engaging shaft 121*a* for engaging with the keycap 130. The connecting member 122 has a sliding shaft 122*a* for engaging with the keycap 130. The keycap 130 includes a pressing body 131, a shaft hole structure 132, and a sliding trough structure 133. The pressing body 131 has a bottom surface 131*a*. The shaft hole structure 132 and the sliding trough structure 133 are connected to the bottom surface 131*a*. The shaft hole structure 132 has an engaging trough 132*a* and an inlet passage 132*b* communicated with each other. The engaging shaft 121*a* is rotatably engaged with the engaging trough 132*a*. The sliding shaft 122*a* is slidably engaged with the sliding trough structure 133.

When assembling, the keycap 130 can be moved obliquely to engage the sliding trough structure 133 with the sliding shaft 122*a*, as shown in FIG. 2. At this time, the inlet passage 132*b* of the shaft hole structure 132 just abuts against the engaging shaft 121*a* of the connecting member 121. Then, the keycap 130 is pressed down such that the engaging shaft 121*a* of the connecting member 121 is engaged with the engaging trough 132*a* through the inlet passage 132*b*, as shown in FIG. 3. Finally, the keyswitch device 100 may further include a position-returning member (not shown, such as a rubber dome) disposed between the bottom plate 110 and the keycap 130, and the position-returning member can lift the keycap 130 to the unpressed position (i.e., the highest position in the stroke of the keycap 130 when the keycap 130 is pressed), as shown in FIG. 4.

In the present embodiment, the connecting assembly 120 uses a scissors-like connecting structure as an embodiment, but the disclosure is not limited in this regard. In practical applications, the connecting assembly 120 may be replaced with other supporting structures with similar functions (that is, moving the keycap 130 upward and downward relative to the bottom plate 110), such as a V-shaped, a A-shaped, or a two-parallel linkage structure.

Figure 5:
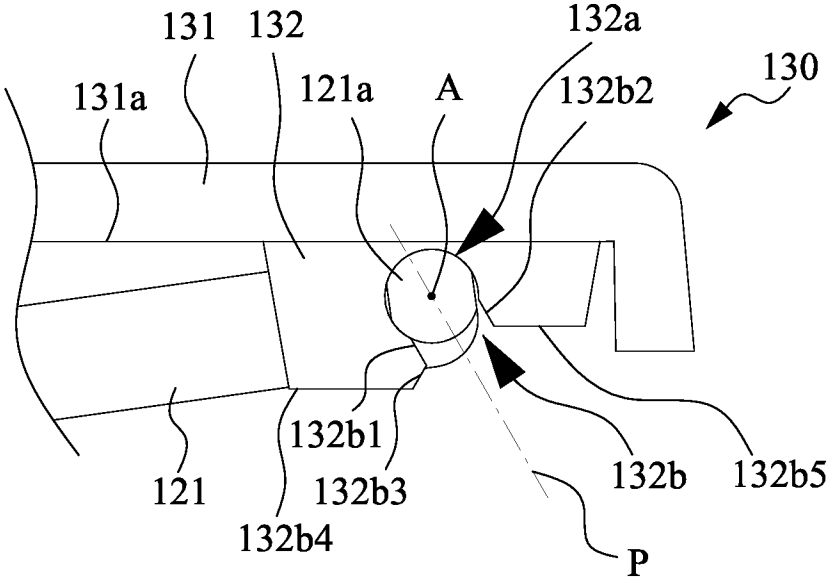
FIG. 5 is a partial enlarged view of the keyswitch device in FIG. 4.

Reference is made to FIG. 5. FIG. 5 is a partial enlarged view of the keyswitch device 100 in FIG. 4. As shown in FIG. 5, in the present embodiment, the inlet passage 132*b* has a first inner wall 132*b*1 and a second inner wall 132*b*2 opposite to each other. The first inner wall 132*b*1 and the second inner wall 132*b*2 are inclined relative to the bottom surface 131*a* of the pressing body 131. With reference to FIG. 2, the first inner wall 132*b*1 is closer to a center of the pressing body 131 than the second inner wall 132*b*2. As shown in FIG. 1, an included angle θ is formed between a normal line N of the bottom surface 131*a* at a center of the engaging trough 132*a* and the first inner wall 132*b*1. The first inner wall 132*b*1 and the second inner wall 132*b*2 are inclined relative to the normal line N and away from the center of the pressing body 131.

With the foregoing structural configurations, the amount of interference in a horizontal direction between the shaft hole structure 132 and the engaging shaft 121*a* of the connecting member 121 below can be increased during a pull test of the keycap 130, thereby effectively improving the tensile strength of the keycap 130. In other words, the tensile strength of the keycap 130 can be significantly improved by appropriately adjusting the aforementioned amount of interference.

In some embodiments, the included angle θ is 10 to 45 degrees. When the included angle θ is less than the aforementioned range, the amount of interference in the horizontal direction between the shaft hole structure 132 and the engaging shaft 121*a* may not be large enough, and the tensile strength of the keycap 130 cannot be effectively improved (i.e., easy to be disassembled). When the included angle θ is greater than the aforementioned range, the inlet passage 132*b* will be too inclined, which will cause it to be difficult for the engaging shaft 121*a* to enter the engaging trough 132*a* through the inlet passage 132*b* when the keycap 130 is pressed down in the assembly stage shown in FIG. 2 (i.e., difficult to be assembled).

Furthermore, in the present embodiment, the first inner wall 132*b*1 and the second inner wall 132*b*2 are parallel to each other. Hence, the structural strength of the shaft hole structure 132 at the inlet passage 132*b* can be effectively increased, so that the tensile strength of the keycap 130 can be further improved.

As shown in FIG. 5, in the present embodiment, the engaging shaft 121*a* has a central axis A. An imaginary line P extending along a radial direction perpendicular to the central axis A is equally spaced between the first inner wall 132*b*1 and the second inner wall 132*b*2. Hence, when the engaging shaft 121*a* is pressed into the engaging trough 132*a* obliquely, the amounts of interference of the first inner wall 132*b*1 and the second inner wall 132*b*2 with the engaging shaft 121*a* are the same, so that the engaging shaft 121*a* can accurately enter the engaging trough 132*a* through the inlet passage 132*b*.

It is clear from the foregoing disclosure that the shaft hole structure 132 having the aforementioned structural configurations has the advantages of being easy to be assembled and difficult to be disassembled with respect to the engaging shaft 121*a*.

In some embodiments, as shown in FIG. 5, the shaft hole structure 132 further includes a first bottom surface 132*b*4 and a second bottom surface 132*b*5. The first bottom surface 132*b*4 and the second bottom surface 132*b*5 are respectively connected to the first inner wall 132*b*1 and the second inner wall 132*b*2. A height of the first bottom surface 132*b*4 relative to the bottom surface 131*a* is greater than a height of the second bottom surface 132*b*5 relative to the bottom surface 131*ay*. The height difference between the first bottom surface 132*b*4 and the second bottom surface 132*b*5 facilitates the alignment between the engaging shaft 121*a* and the inlet passage 132*b* in the assembly stage shown in FIG. 2.

In some embodiments, as shown in FIG. 5, the shaft hole structure 132 further includes a chamfer 132*b*3. The chamfer 132*b*3 is connected to an end of the first inner wall 132*b*1 away from the engaging trough 132*a*. That is, the chamfer 132*b*3 is connected between the first inner wall 132*b*1 and the first bottom surface 132*b*4. When the keycap 130 is pressed down to move the engaging shaft 121*a* from the first bottom surface 132*b*4 to abut against the inlet passage 132*b*, the chamfer 132*b*3 can reduce the obstruction of the shaft hole structure 132 to the engaging shaft 121*a*.

Figure 6:
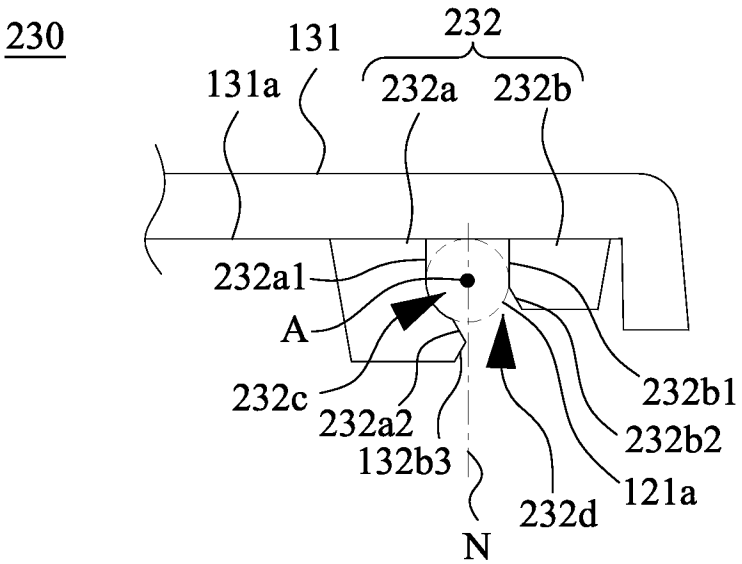
FIG. 6 is a partial schematic diagram of a keycap according to another embodiment of the present disclosure.

Reference is made to FIG. 6. FIG. 6 is a partial schematic diagram of a keycap 230 according to another embodiment of the present disclosure. As shown in FIG. 6, in the present embodiment, the keycap 230 includes a pressing body 131 and a shaft hole structure 232. The pressing body 131 is identical to that of the embodiment shown in FIG. 5 and will not repeated here for simplicity. The shaft hole structure 232 includes a first side engaging block 232*a* and a second side engaging block 232*b*. The first side engaging block 232*a* forms one part of the engaging trough 232*c* and has the first inner wall 232*a*2. The second side engaging block 232*b* forms another part of the engaging trough 232*c* and has the second inner wall 232*b*2. The first side engaging block 232*a* and the second side engaging block 232*b* are connected to the bottom surface 131*a* and spaced apart from each other.

In the embodiment where the keycap 230 is made of plastic through an injection molding process, by designing the shaft hole structure 232 to include the first side engaging block 232*a* and the second side engaging block 232*b* that are spaced apart from each other, the problem of material shrinkage at the location of the pressing body 131 of the keycap 230 corresponding to the shaft hole structure 232 can be effectively solved.

As shown in FIG. 6, a height of the first side engaging block 232*a* relative to the bottom surface 131*a* is greater than a height of the second side engaging block 232*b* relative to the bottom surface 131*a*. The height difference between the first side engaging block 232*a* and the second side engaging block 232*b* facilitates the alignment between the engaging shaft 121*a* and an inlet passage 232*d* in the assembly stage shown in FIG. 2.

In detail, the first side engaging block 232*a* and the second side engaging block 232*b* respectively has a first engaging wall 232*a*1 and a second engaging wall 232*b*1. The first engaging wall 232*a*1 and the second engaging wall 232*b*1 are respectively connected to the first inner wall 232*a*2 and the second inner wall 232*b*2 and configured to be engaged with the engaging shaft 121*a*. The engaging trough 232*c* is formed at least by the first engaging wall 232*a*1 and the second engaging wall 232*b*1.

In the embodiment as shown in FIG. 6, a part of the first engaging wall 232*a*1 and the second engaging wall 232*b*1 are straight walls. These straight walls are perpendicular to the bottom surface 131*a* of the pressing body 131. The normal line N of the bottom surface 131*a* at the center of the engaging trough 232*c* is parallel and equidistantly located between the first engaging wall 232*a*1 and the second engaging wall 232*b*1, so that the engaging shaft 121*a* (indicated by the dotted line in FIG. 6) firmly abuts between the first engaging wall 232*a*1 and the second engaging wall 232*b*1 while being engaged in the engaging trough 232*c*. However, the present disclosure is not limited in this regard.

Figure 7:
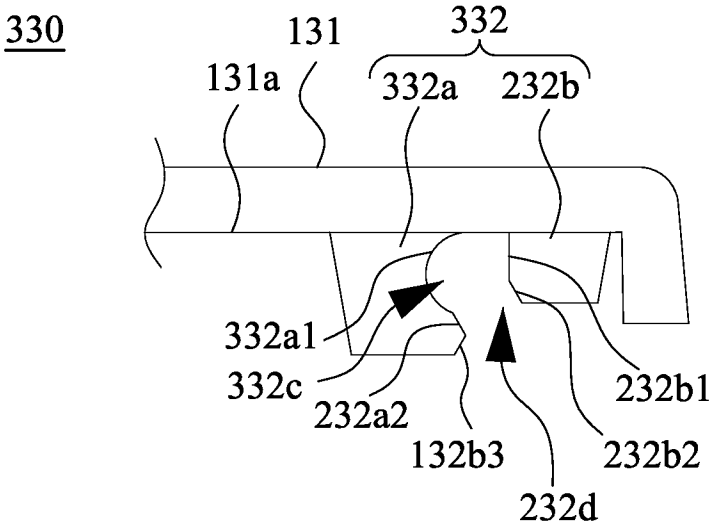
FIG. 7 is a partial schematic diagram of a keycap according to another embodiment of the present disclosure.

Reference is made to FIG. 7. FIG. 7 is a partial schematic diagram of a keycap 330 according to another embodiment of the present disclosure. As shown in FIG. 7, in the present embodiment, the keycap 330 includes a pressing body 131 and a shaft hole structure 332. The pressing body 131 is identical to that of the embodiment shown in FIG. 5 and will not repeated here for simplicity. The shaft hole structure 332 includes a first side engaging block 332*a* and a second side engaging block 232*b*. The first side engaging block 332*a* forms one part of the engaging trough 332*c* and has the first inner wall 232*a*2. The second side engaging block 232*b* forms another part of the engaging trough 332*c*. The first side engaging block 332*a* and the second side engaging block 232*b* are connected to the bottom surface 131*a* and spaced apart from each other. The first side engaging block 332*a* has a first engaging wall 332*a*1. The first engaging wall 332*a*1 is connected to the first inner wall 232*a*2. It should be noted that, compared with the embodiment shown in FIG. 6, the first engaging wall 332*a*1 of the present embodiment is an arcuate wall and is configured to fit a part of the surface of the engaging shaft 121*a*, thereby increasing the contact area.

Figure 8:
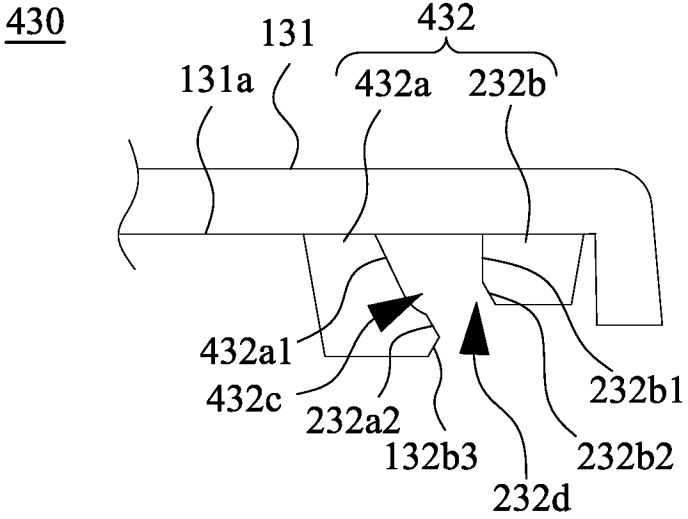
FIG. 8 is a partial schematic diagram of a keycap according to another embodiment of the present disclosure.

Reference is made to FIG. 8. FIG. 8 is a partial schematic diagram of a keycap 430 according to another embodiment of the present disclosure. As shown in FIG. 8, in the present embodiment, the keycap 430 includes a pressing body 131 and a shaft hole structure 432. The pressing body 131 is identical to that of the embodiment shown in FIG. 5 and will not repeated here for simplicity. The shaft hole structure 432 includes a first side engaging block 432*a* and a second side engaging block 232*b*. The first side engaging block 432*a* forms one part of the engaging trough 432*c* and has the first inner wall 232*a*2. The second side engaging block 232*b* forms another part of the engaging trough 432*c*. The first side engaging block 432*a* and the second side engaging block 232*b* are connected to the bottom surface 131*a* and spaced apart from each other. The first side engaging block 432*a* has a first engaging wall 432*a*1. The first engaging wall 432*a*1 is connected to the first inner wall 232*a*2. It should be noted that, compared with the embodiment shown in FIG. 6, the portion that is a straight wall of the first engaging wall 432*a*1 is inclined relative to the bottom surface 131*a* of the pressing body 131.

Figure 9:
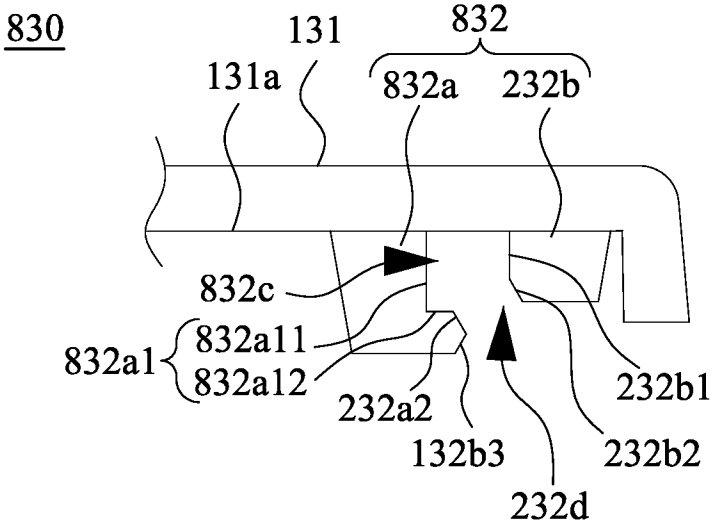
FIG. 9 is a partial schematic diagram of a keycap according to another embodiment of the present disclosure.

Reference is made to FIG. 9. FIG. 9 is a partial schematic diagram of a keycap 830 according to another embodiment of the present disclosure. As shown in FIG. 9, in the present embodiment, the keycap 830 includes a pressing body 131 and a shaft hole structure 832. The pressing body 131 is identical to that of the embodiment shown in FIG. 5 and will not repeated here for simplicity. The shaft hole structure 832 includes a first side engaging block 832*a* and a second side engaging block 232*b*. The first side engaging block 832*a* forms one part of the engaging trough 832*c* and has the first inner wall 232*a*2. The second side engaging block 232*b* forms another part of the engaging trough 832*c*. The first side engaging block 832*a* and the second side engaging block 232*b* are connected to the bottom surface 131*a* and spaced apart from each other. The first side engaging block 832*a* has a first engaging wall 832*a*1. The first engaging wall 832*a*1 is connected to the first inner wall 232*a*2. It should be noted that, compared with the embodiment shown in FIG. 6, the first engaging wall 832*a*1 of the present embodiment has a first wall portion 832*a*11 and a second wall portion 832*a*12 connected to each other. The first wall portion 832*a*11 is connected between the bottom surface 131*a* and the second wall portion 832*a*12. The second wall portion 832*a*12 is connected between the first wall portion 832*a*11 and the first inner wall 232*a*2. Both the first wall portion 832*a*11 and the second wall portion 832*a*12 are straight walls and a right angle is formed therebetween.

In the embodiments shown in FIGS. 6 to 9, the wall surface of the engaging walls can include a vertical surface, an arcuate surface, an inclined straight surface, or straight surfaces forming a right angle. The connecting areas between these structures and the bottom surface 131*a* of the pressing body 131 becomes uniform, so that the surface of the keycap 130 is less prone to surface shrinkage during plastic injection molding, and the structural strength of taper pins of the plastic mold design can also be increased.

In addition, in the embodiments shown in FIGS. 6 to 9, an end of the first inner wall 232*a*2 away from the engaging troughs 232*c*, 332*c*, 432*c*, 832*c* can be further connected to the chamfer 132*b*3 as shown in FIG. 5. When the keycap 130 is pressed down to move the engaging shaft 121*a* from the first side engaging blocks 232*a*, 332*a*, 432*a*, 832*a* to abut against the inlet passage 232*d*, the chamfer 132*b*3 can reduce the obstruction of the shaft hole structure 132 to the engaging shaft 121*a*.

Figure 10:
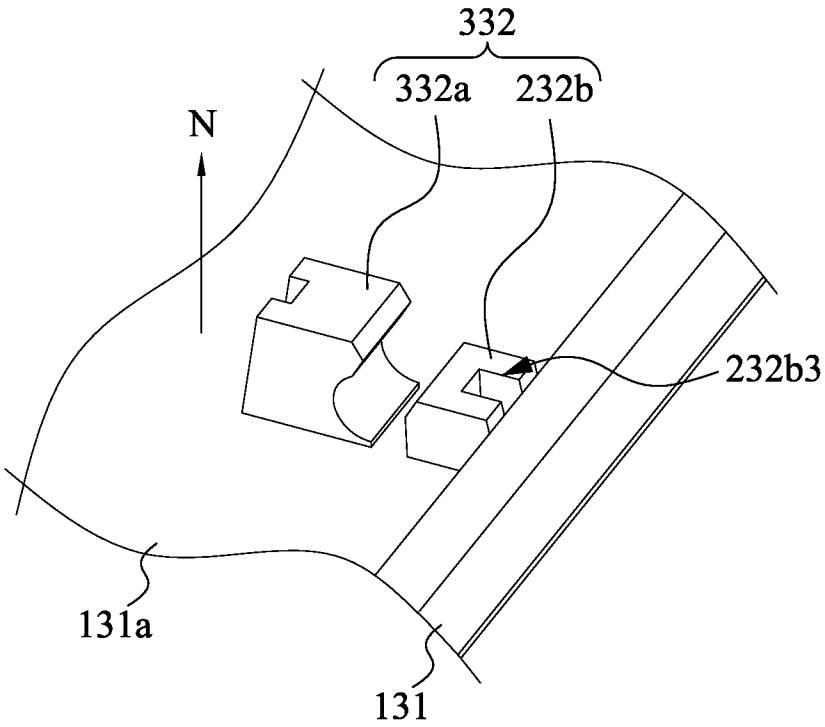
FIG. 10 is a partial perspective view of the keycap in FIG. 7.

Reference is made to FIG. 10. FIG. 10 is a partial perspective view of the keycap 330 in FIG. 7. As shown in FIG. 10, in the present embodiment, the shaft hole structure 332 only includes one first side engaging block 332*a* and one second side engaging block 232*b*. However, the present disclosure is not limited in this regard. Specifically, the second side engaging block 232*b* has a notch 232*b*3. The notch 232*b*3 is located at a side of the second side engaging block 232*b* away from the first side engaging block 332*a* and is formed along the normal line N to abut against the bottom surface 131*a* of the pressing body 131. Hence, the thickness of the second side engaging block 232*b* is uniform, which helps to reduce the shrinkage of the surface of the keycap 130 during plastic injection molding.

Figure 11:
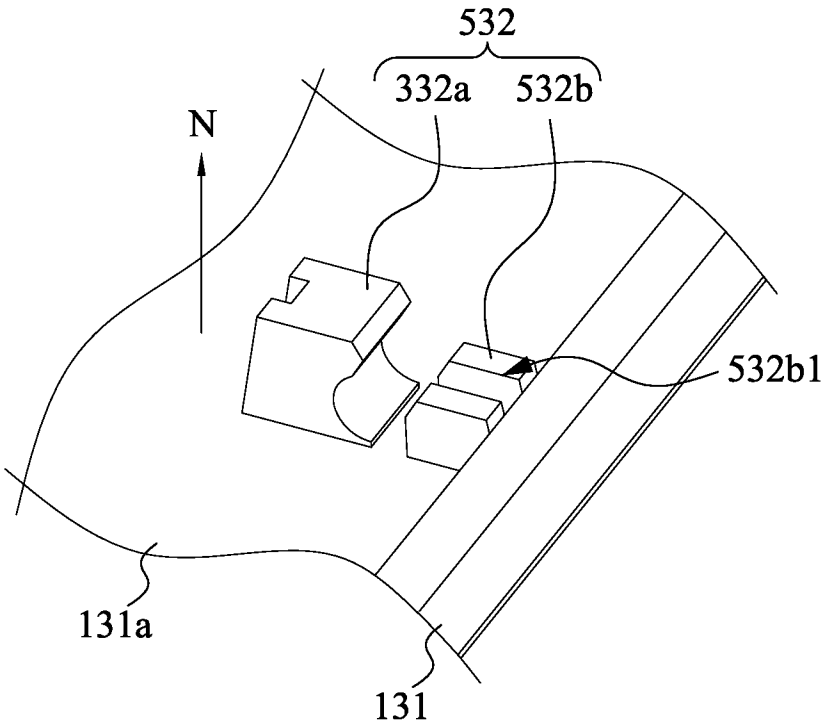
FIG. 11 is a partial perspective view of a keycap according to another embodiment of the present disclosure.
Figure 12:
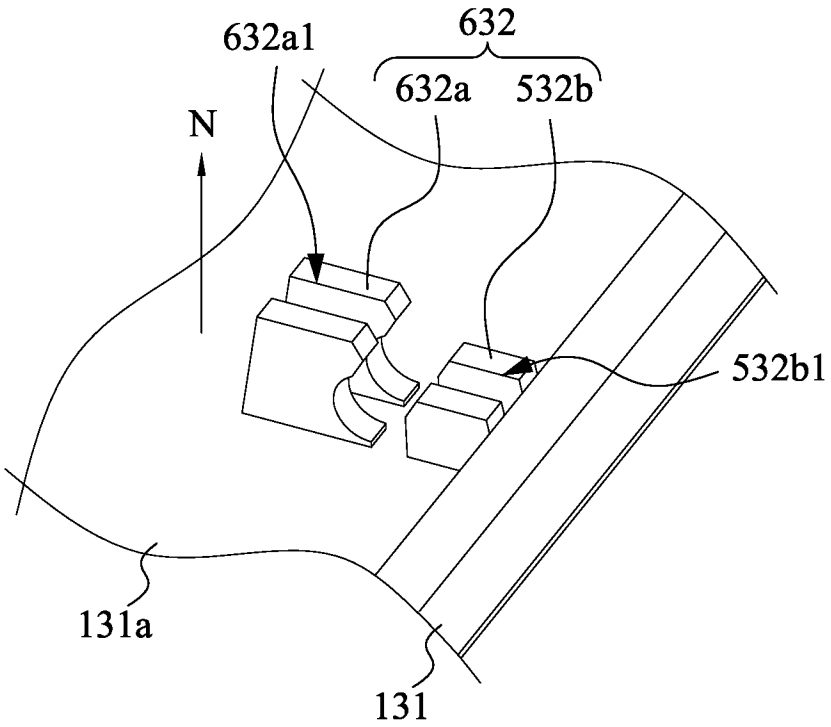
FIG. 12 is a partial perspective view of a keycap according to another embodiment of the present disclosure.
Figure 13:
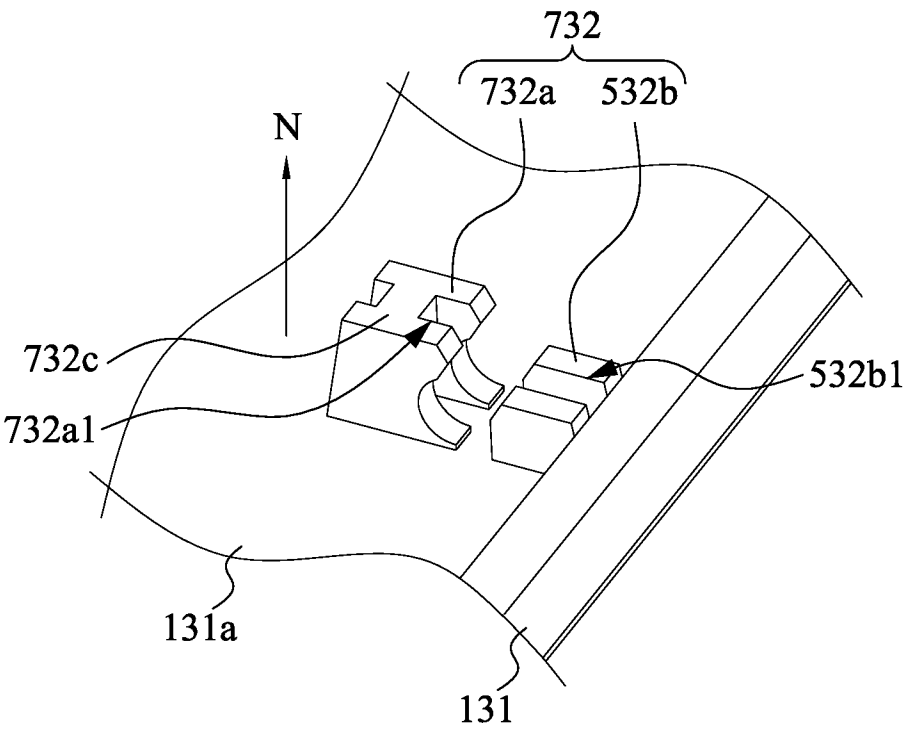
FIG. 13 is a partial perspective view of a keycap according to another embodiment of the present disclosure.

Reference is made to FIG. 11. FIG. 11 is a partial perspective view of a keycap 530 according to another embodiment of the present disclosure. As shown in FIG. 11, in the present embodiment, the shaft hole structure 532 includes one first side engaging block 332*a* and two second side engaging blocks 532*b*. By replacing the single second side engaging block 232*b* shown in FIG. 10 with the two second side engaging blocks 532*b* of the present embodiment, the problem of material shrinkage at the locations of the pressing body 131 of the keycap 530 corresponding to the second side engaging blocks 532*b* can be further avoided. Specifically, the two second side engaging blocks 532*b* have a notch 532*b*1 therebetween, and the notch 532*b*1 penetrates from the side of the second side engaging blocks 532*b* away from the first side engaging block 332*a* to the side of the second side engaging blocks 532*b* close to the first side engaging block 332*a*. Reference is made to FIG. 12. FIG. 12 is a partial perspective view of a keycap 630 according to another embodiment of the present disclosure. As shown in FIG. 12, in the present embodiment, the shaft hole structure 632 includes two first side engaging blocks 632*a* and two second side engaging blocks 532*b*. By replacing the single first side engaging block 332*a* shown in FIG. 11 with the two first side engaging blocks 632*a* of the present embodiment, the problem of material shrinkage at the locations of the pressing body 131 of the keycap 630 corresponding to the first side engaging blocks 632*a* can be further avoided. Specifically, the two first side engaging blocks 632*a* have a notch 632*a*1 therebetween, and the notch 632*a*1 penetrates from the side of the first side engaging blocks 632*a* away from the second side engaging blocks 532*b* to the side of the first side engaging blocks 632*a* close to the second side engaging blocks 532*b*. Reference is made to FIG. 13. FIG. 13 is a partial perspective view of a keycap 730 according to another embodiment of the present disclosure. Compared with the embodiment as shown in FIG. 12, the shaft hole structure 732 of the present embodiment further includes a rib 732*c* connected between two first side engaging blocks 732*a*, so as to the entire structural strength of the two first side engaging blocks 732*a*.

According to the foregoing recitations of the embodiments of the disclosure, it can be seen that in the keyswitch device of the present disclosure, since the shaft hole structure at the bottom of the keycap has the inclined inlet passage (i.e., the first inner wall and the second inner wall are inclined relative to the bottom surface of the pressing body), the amount of interference in a horizontal direction between the shaft hole structure and the engaging shaft of the connecting member below can be increased during a pull test of the keycap, thereby effectively improving the tensile strength of the keycap. Furthermore, by making the first inner wall and the second inner wall parallel to each other, the structural strength of the shaft hole structure at the inlet passage can be effectively increased, thereby further improving the tensile strength of the keycap.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyswitch device, comprising:

a connecting member having an engaging shaft; and a keycap comprising:

a pressing body having a bottom surface; and a shaft hole structure directly connected to the bottom surface and having an engaging trough and an inlet passage communicated with each other, wherein the engaging shaft is rotatably engaged in the engaging trough, wherein the inlet passage has a first inner wall and a second inner wall opposite and parallel to each other, and the first inner wall and the second inner wall are inclined relative to the bottom surface of the pressing body, wherein the first inner wall is closer to a center of the pressing body than the second inner wall, and the first inner wall and the second inner wall are inclined away from the center of the pressing body, wherein a moving direction of the keycap is parallel to a normal line of the bottom surface at a center of the engaging trough.

2. The keyswitch device of claim 1, wherein the engaging shaft has a central axis, and an imaginary line extending along a radial direction perpendicular to the central axis is equally spaced between the first inner wall and the second inner wall.

3. The keyswitch device of claim 1, wherein the shaft hole structure comprises:

at least one first side engaging block forming one part of the engaging trough and having the first inner wall; and at least one second side engaging block forming another part of the engaging trough and having the second inner wall, wherein the at least one first side engaging block and the at least one second side engaging block are connected to the bottom surface and spaced apart from each other.

4. The keyswitch device of claim 3, wherein the at least one first side engaging block and the at least one second side engaging block respectively has a first engaging wall and a second engaging wall, the first engaging wall and the second engaging wall are respectively connected to the first inner wall and the second inner wall and configured to be engaged with the engaging shaft, and the engaging trough is formed at least by the first engaging wall and the second engaging wall.

5. The keyswitch device of claim 4, wherein at least one part of one the first engaging wall and the second engaging wall is a straight wall.

6. The keyswitch device of claim 5, wherein the straight wall is perpendicular to the bottom surface of the pressing body.

7. The keyswitch device of claim 5, wherein the straight wall is inclined relative to the bottom surface of the pressing body.

8. The keyswitch device of claim 4, wherein the first engaging wall is an arcuate wall.

9. The keyswitch device of claim 3, wherein the shaft hole structure further comprises a chamfer, and the chamfer is connected to an end of the first inner wall away from the engaging trough.

10. The keyswitch device of claim 1, wherein the shaft hole structure comprises a first bottom surface and a second bottom surface, and a height of the first bottom surface relative to the bottom surface of the pressing body is greater than a height of the second bottom surface relative to the bottom surface of the pressing body.

11. The keyswitch device of claim 1, wherein an included angle is formed between the normal line of the bottom surface and the first inner wall, and the included angle is 10 to 45 degrees.

12. The keyswitch device of claim 1, wherein the shaft hole structure further comprises a chamfer, and the chamfer is connected to an end of the first inner wall away from the engaging trough.

* * * * *